US006817220B2

(12) United States Patent
Liu

(10) Patent No.: US 6,817,220 B2
(45) Date of Patent: Nov. 16, 2004

(54) MOLD HEAD DEVICE OF SPRING FORMING MACHINE

(75) Inventor: Tsun-Te Liu, Hsin-Chuang (TW)

(73) Assignee: Shin Chuau HWA Co., Ltd., Taoyuan (TW)

( * ) Notice: Subject to any disclaimer, the term of this patent is extended or adjusted under 35 U.S.C. 154(b) by 51 days.

(21) Appl. No.: 10/303,860

(22) Filed: Nov. 26, 2002

(65) Prior Publication Data

US 2004/0099031 A1 May 27, 2004

(51) Int. Cl.[7] ..... B21F 35/02
(52) U.S. Cl. ..... 72/137; 72/477
(58) Field of Search ..... 72/137, 149, 157, 72/159, 217, 219, 387, 388, 477; 140/103

(56) References Cited

U.S. PATENT DOCUMENTS 4,718,265 A * 1/1988 Post ..... 72/217
6,029,494 A * 2/2000 Wu ..... 72/387

* cited by examiner

*Primary Examiner*—Lowell A. Larson
(74) *Attorney, Agent, or Firm*—Birch, Stewart, Kolasch & Birch, LLP

(57) ABSTRACT

A mold head device of a spring forming machine is disclosed. The mold head device includes a rotation mechanism controlling rotation of a rotation head and a linear motion mechanism controlling linear motion of a mold head. The mold head has a plurality of sector-shaped chunk blocks defining diametrically extending channels therebetween for accommodating a spring wire that makes springs. Each chunk block has circumferentially opposite rounded corners having different radii of curvature. The rotation head has a projection engaging and applying a bending force to the wire so as to bend the wire about one of corners of the chunk blocks thereby forming an arc bending of the wire having a radius of curvature corresponding to that of the corner.

7 Claims, 5 Drawing Sheets

MOLD HEAD DEVICE OF SPRING FORMING MACHINE

FIELD OF THE INVENTION

The present invention relates to a mold head of spring forming machine for bending wires that makes spring, and more specifically to a mold head capable of bending the wires with different radii of curvature for making springs of different specifications.

BACKGROUND OF THE INVENTION

A conventional spring forming machine feed wires that make springs by means of transportation rollers. A first bending operation is performed on a predetermined length of the spring wire to form a curved hook of a predetermined angle. The length of the wire is then swirled to form helical configuration. Thereafter a second bending operation is performed on an opposite end of the length of the spring wire to form another curved hook. By cutting the spring so formed off the spring wire, the spring product is completed.

In order to make springs having curved hooks of different bending angles, many sets of bending tools of different specifications are required. This complicates the spring forming machine and increases costs thereof.

Spring forming machines comprising a single computer-controlled bending tool for forming curved hooks of different bending angles are known, which allows for formation of different curved hooks with a single set of bending tool. Such spring forming machines, however, has disadvantages, such as:

(1) Although the curved hooks of different bending angles can be formed with a single set of tool, it still requires a number of different mold heads for forming curved hook having different radii of curvature. The costs are still high.

(2) The mechanism required for controlling the bending operation of the spring wire is complicated, leading to high costs.

It is a purpose of this invention to provide a mold head device of a spring forming machine. The mold head can be assembled and reassembled easily. The mold head has a plurality of chunk blocks each having rounded corners of different radii of curvature, allowing a spring wire to be bent with different radius of curvature. The unique mold head could replace the traditional complicated forming machine and save a lot of expense.

It is another purpose of this invention to provide a mold head device of a spring forming machine, wherein the mold head device comprises a rotation mechanism for rotatably driving a rotation head and a linear motion mechanism for linearly and axially moving a mold head. The mold head has a plurality of chunk blocks defining therebetween channels for accommodating a spring wire. Each chunk block has rounded corners of different radii of curvature. The rotation head has a projection capable to engage and drive an end of the spring wire to rotate about the rounded corner of the chunk block to form curved hook having radius of curvature corresponding to that of the rounded corner.

SUMMARY OF THE INVENTION

The above problems are at least partially solved and the above purposes and others are realized in a mold head of a spring forming machine shown as follow:

The present invention relates to mold head device of a spring forming machine. The device comprises a rotation mechanism, a linear motion mechanism, a rotation head and a mold head. The rotation head has a projection and can be rotated by the rotation mechanism. The mold head is fixed to a center shaft of the linear motion mechanism and can be driven back and forward linearly. The mold head has a plurality of chunk blocks, wherein diametrically extending channels are defined between the chunk blocks. Each corner end of each chunk block is contoured as an arc having different radii of curvature. To bend an end of a spring wire, the linear motion mechanism moves to have the spring wire received in one of the channels. Furthermore, the rotation head swirls in accordance with the rotation mechanism and uses one of the chunk blocks as a pivot, theprojection of the rotation head providing a bending force on the spring wire and bending the spring to a certain angle.

BRIEF DESCRIPTION OF THE DRAWING

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE INVENTION

Figure 1:
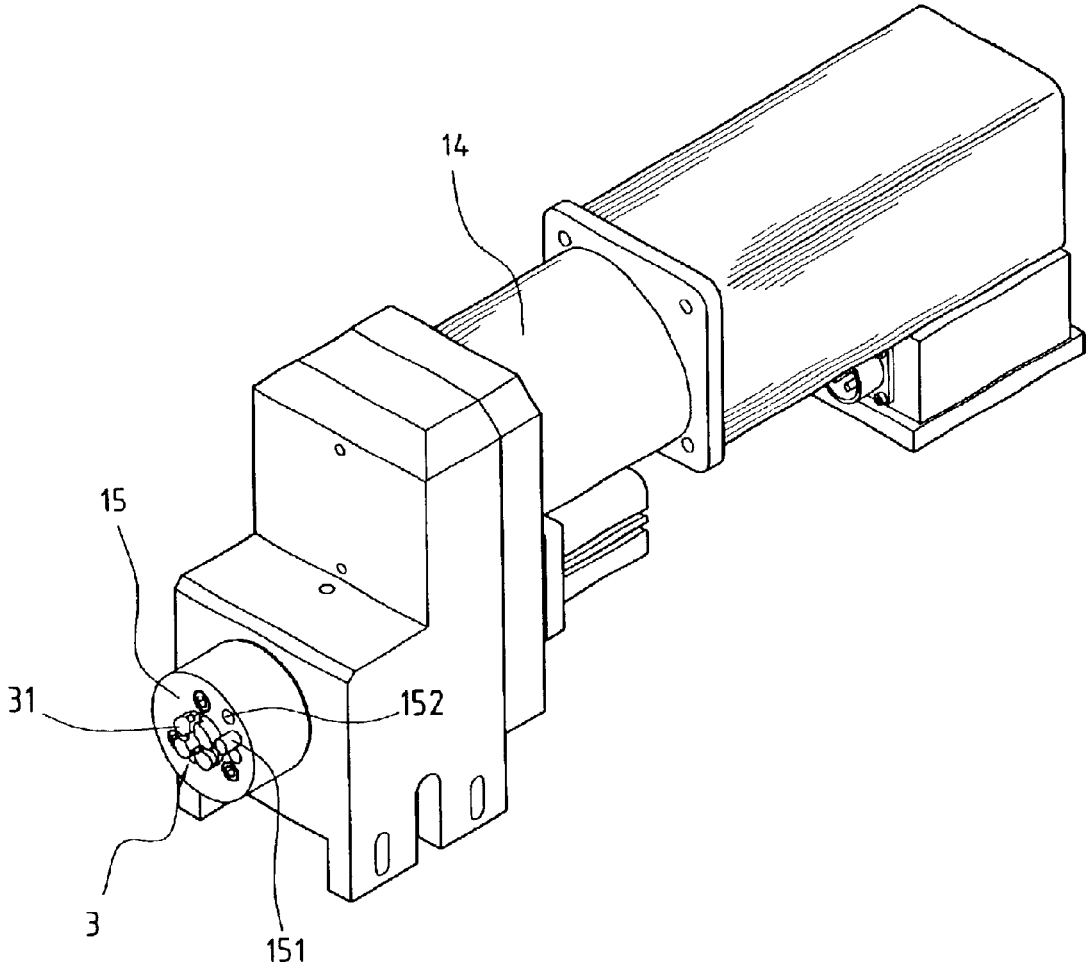
FIG. 1 depicts a perspective view showing a mold head device of the present invention.
Figure 2:
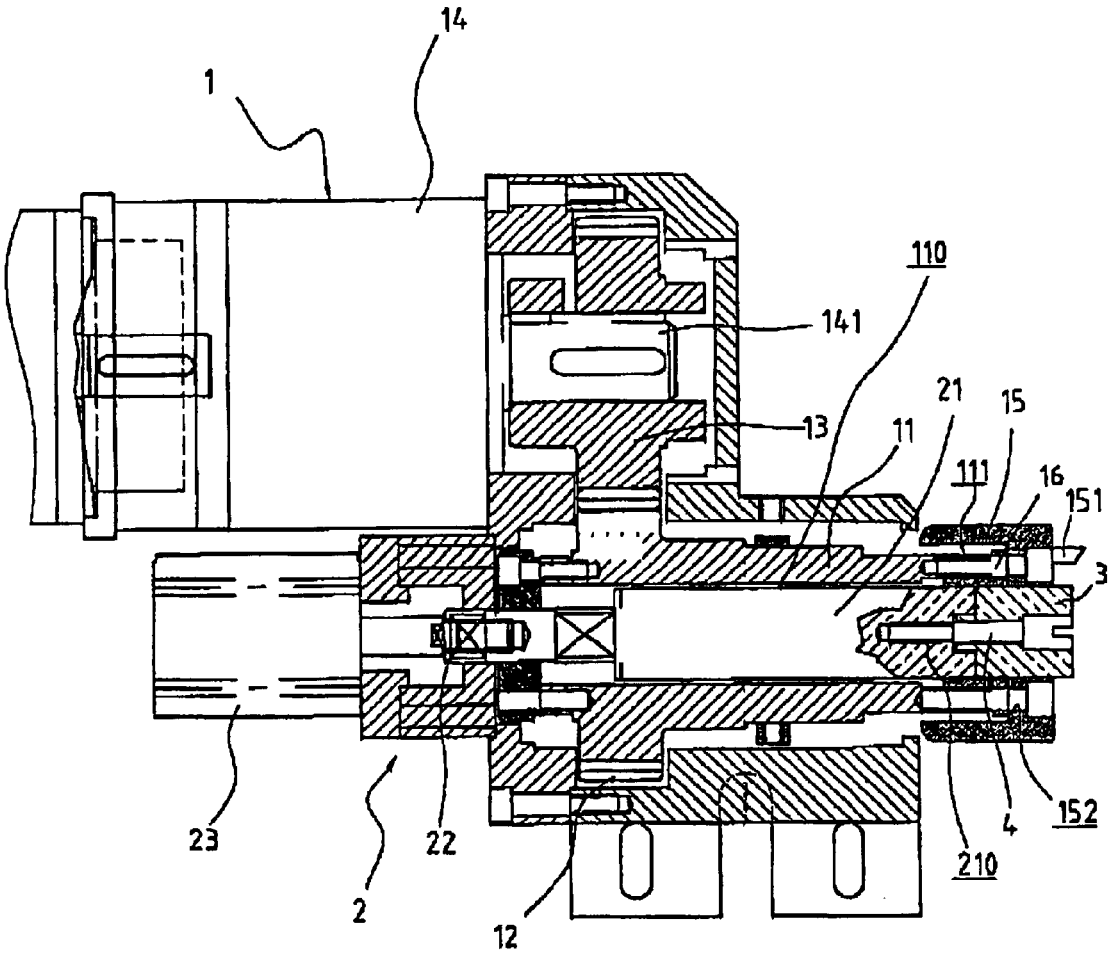
FIG. 2 depicts a cross-sectional view of the mold head device of the present invention.

With reference to the drawings and in particular to FIGS. 1 and 2, a spring forming machine comprises a mold head device comprising a rotation mechanism 1 and a linear motion mechanism 2. The rotation mechanism 1 comprises a cylindrical body 11 defining a central bore (not labeled). A driven gear 12 is formed around the cylindrical body 11 in proximity of an inner end thereof. A plurality of threaded holes 111 is defined in an end surface (not labeled) of an outer end of the cylindrical body 11. The driven gear 12 mates a driving gear 13 that is mounted to a spindle 141 of a motor 14 whereby the cylindrical body 11 is driven by the motor 14 for rotation.

A rotation head 15 is mounted to the outer end of the cylindrical body 11 by means of bolts 16 extending through holes 152 defined in the rotation head 15 and engaging the threaded holes 111 of the cylindrical body 11. The rotation head 15 defines a central bore 150 into which a mold head constructed in accordance with the present invention and generally designated with reference numeral 3 is positioned. The mold head 3 will be further discussed. A projection 151 is formed on an outer surface (not labeled) of the rotation head 15.

The linear motion mechanism 2 comprises a center shaft 21 axially and movably received in the central bore 110 of the cylindrical body 11 of the rotation mechanism 1. A linear motion driving device 23 is coupled to the center shaft 21 for axially moving the shaft 21 within the cylindrical body 11. An example of the linear motion driving device 23 is a pneumatic cylinder having a cylinder rod (not labeled)

connected to an inner end of the shaft 21 by a coupler 22. An outer end of the center shaft 21 defines a threaded hole 210. The linear motion mechanism 2 further comprises a sliding base 17 for sliding along a track 62 that is mounted to a support plate 6 of the spring forming machine (shown in FIG. 5).

The mold head 3 of the invention is positioned in the central bore of the rotation head 5 and defines a central bore 30 through which a bolt 4 extends. The bolt 4 engages the threaded hole 210 of the rotation head 5 and secures the mold head 3 to the rotation head 5. A cylindrical outer end of the mold head 3 forms a plurality of chunk blocks 31. In the embodiment illustrated, the chunk blocks 31 are formed by two diametrically extending and mutually perpendicular channels 32 defined in the cylindrical outer end of the mold head 3. Thus, each chunk block 31 has an arc outer circumference. The channels 32 intersect at the central bore of the mold head 3 whereby the central bore is centered between the chunk blocks 31 and is substantially concentric with the arc outer circumference of the chunk blocks 31. Each block 31 has a circumferentially opposite corners 311 that are made rounded and having different radii of curvature.

Figure 4:
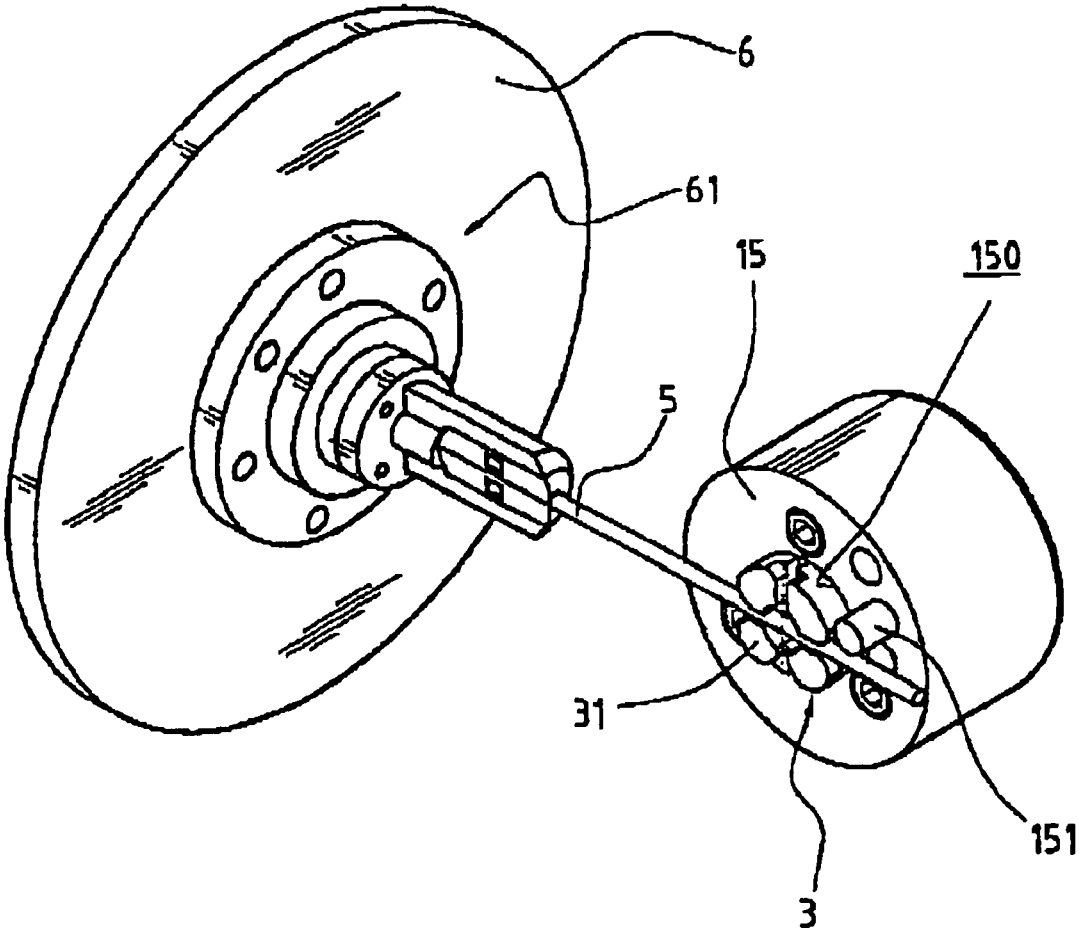
FIG. 4 is a perspective view showing a portion of a spring forming machine in which the mold head of the present invention is incorporated.
Figure 5:
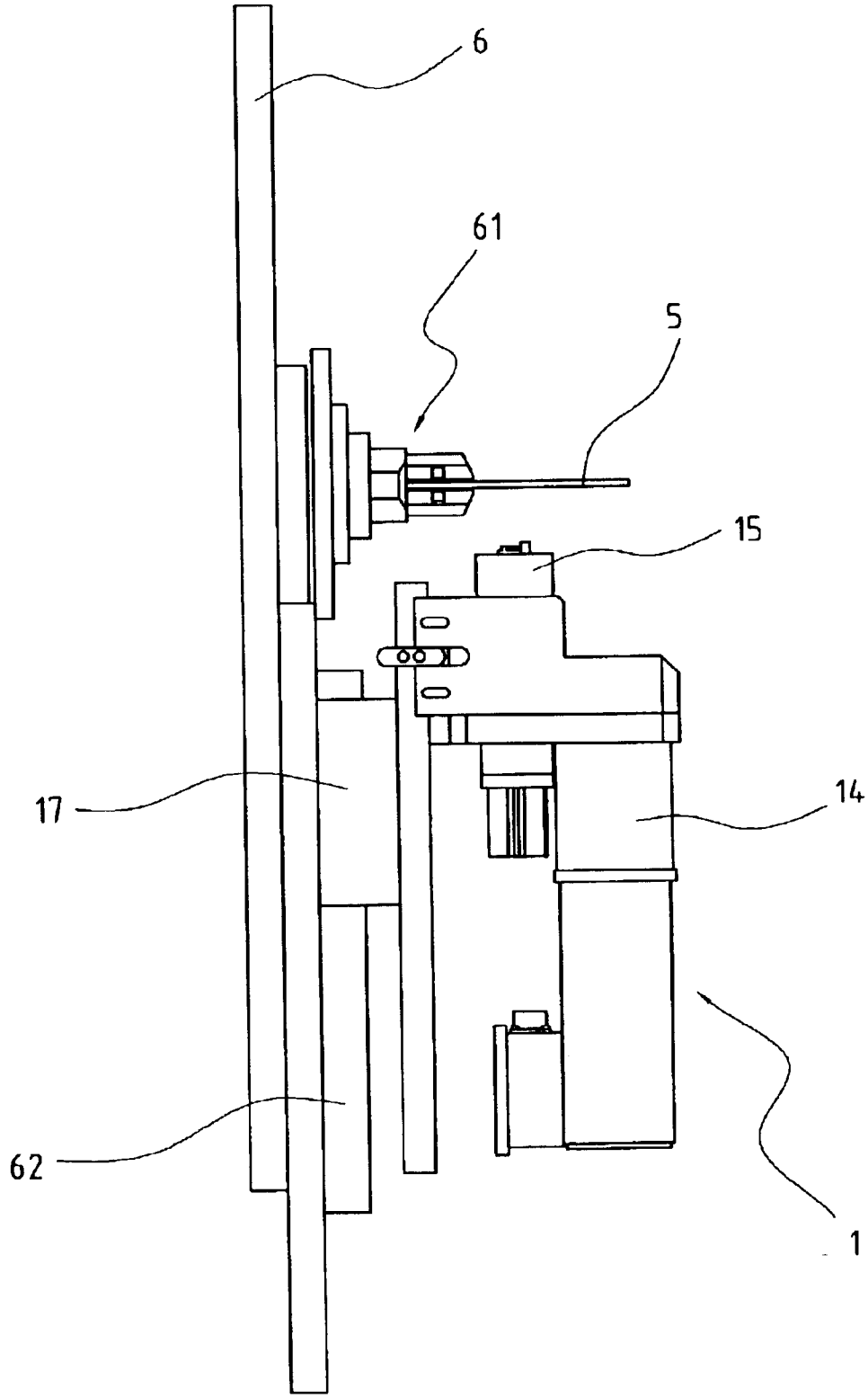
FIG. 5 is a side elevational view of the spring forming machine.

Also referring to FIGS. 4 and 5, the mold head device is mounted to the support plate 6 of the spring forming machine with the mold head 3 facing a wire outlet 61 of the support plate 6 and spaced from a wire 5 fed through the wire outlet 61.

Figure 3A:
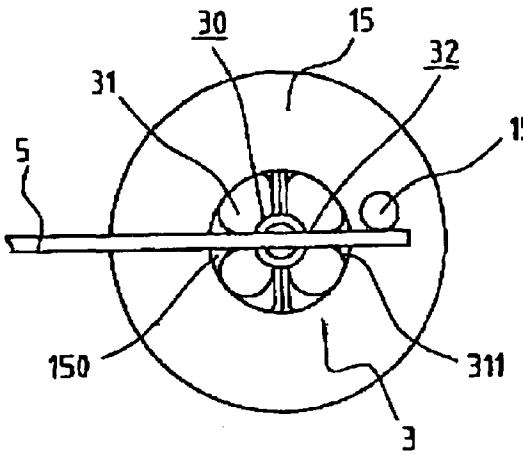
FIGS. 3A to 3F depicts end views of the mold head device in sequence in bending a spring wire.
Figure 3B:
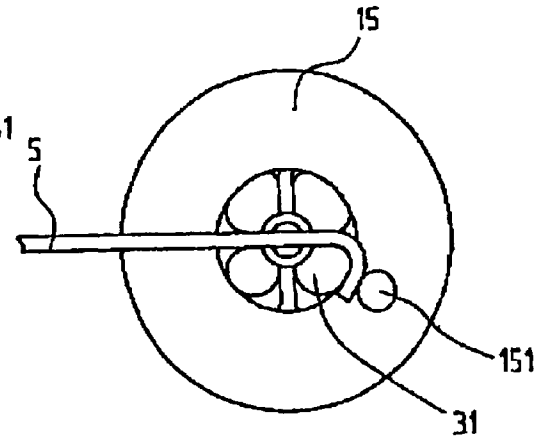
Figure 3C:
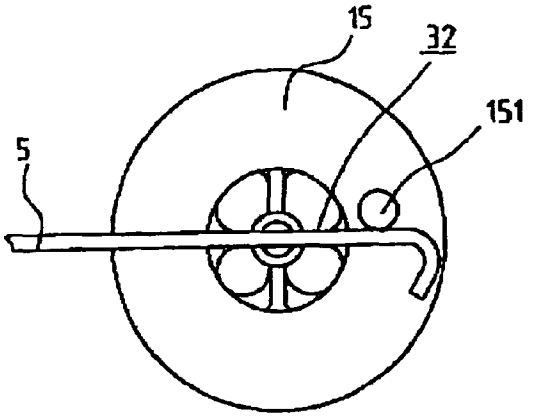
Figure 3D:
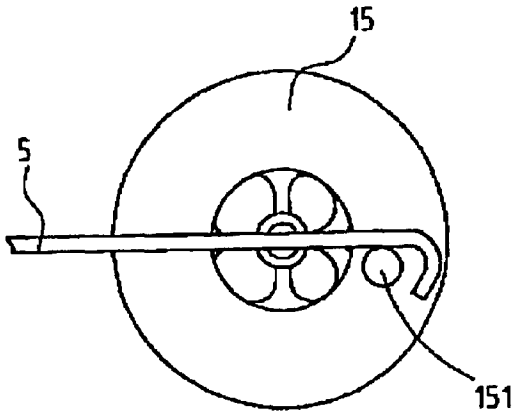
Figure 3E:
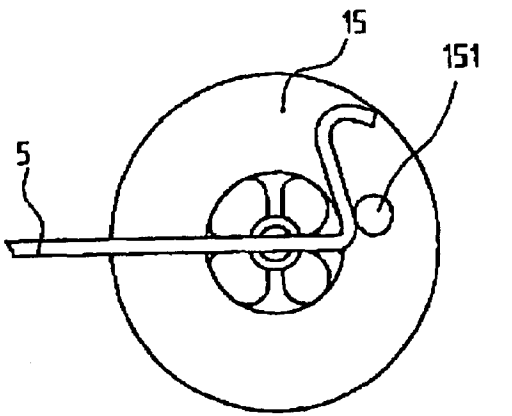
Figure 3F:
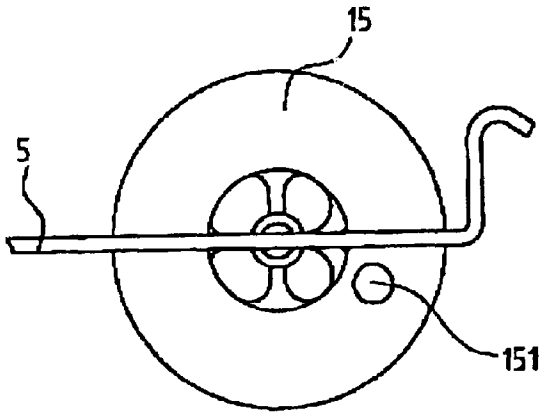

To bend the spring wire 5, the sliding base 17 is moved along the track 62 to bring the mold head 3 close to the wire 5. The pneumatic cylinder 23 of the linear motion mechanism 2 is actuated for fine adjustment of the position of the mold head 3 in order to receive the wire 5 in one of the channels 32 with the projection 151 of the rotation head 15 engaging the wire 5 (as shown in FIG. 3A). Next, the rotation head 15 is driven to rotate clockwise by the rotation mechanism 1. The projection 151 of the rotation head 5 bends the wire 5 about one of the rounded corners of a selected one of the chunk blocks 31 whereby the wire 5 is bent with a radius of curvature corresponding to that of the rounded corner (as shown in FIG. 3B). When the bending is completed, theprojection 151 goes back with the rotation head 15 to the original location, while the spring wire 5 is further fed (as shown in FIG. 3C). Then the rotation head 15 rotates counterclockwise to have the projection 151 engaging the other side of the spring wire 5 (as shown in FIG. 3D) and a bending force is again applied to the wire 5 by the projection 151 to proceed a second bending operation (as shown in FIG. 3E). Finally, the projection 151 is moved by the rotation head 15 to disengage the wire 5 for allowing the wire 5 to be further moved forward (as shown in FIG. 3F) for further processing.

When the bending work of spring wire 5 is accomplished, the spring wire 5 can be further processed to form a helical configuration as a spiral spring. The pneumatic cylinder 23 contracts the shaft 21 and thus detaching the mold head 3 from the spring wire 5.

In accordance with the present invention, the mold head 3 comprises a plurality of chunk blocks 31 having sector configuration and each sector-shaped chunk block 31 has circumferentially opposite corners that are made rounded and having different radii of curvature. The corners of different radii of curvature can be selectively chosen as a pivot for bending the spring wire 5 so as to easily make bending of different radii of curvature. The mold head 3 of the present invention can be readily removed and re-mounted by simply loosening and tightening the bolt 4. This allows for production of springs of different specifications by changing the angular position of the mold head 3 with respect to the rotation head 5.

As mentioned above, through the mold head of the present invention, only a single set of mold head and rotation head is needed to bend curved hook of different radii of curvature.

As will be understood by persons skilled in the art, the foregoing preferred embodiment of the present invention is illustrative of the present invention rather than limiting the present invention. Having described the invention in connection with a preferred embodiment, modification will now suggest itself to those skilled in the art. Thus, the invention is not to be limited to this embodiment, but rather the invention is intended to cover various modifications and similar arrangements included within the spirit and scope of the appended claims, the scope of which should be accorded the broadest interpretation so as to encompass all such modification and similar structure.

While the preferred embodiment of the invention has been illustrated and described, it will be appreciated that various changes can be made therein without departing from the spirit and scope of the invention.

What is claimed is:

1. A mold head device of spring forming machine comprising:

a rotation mechanism having a cylindrical body defining a first central bore, the cylindrical body being drivingly coupled to a torque/rotation source;

a linear motion mechanism having a shaft axially and movably received in the first central bore of the cylindrical body, the shaft being drivingly coupled to a linear motion driving device;

a rotation head fixed to the cylindrical body, the rotation head defining a second central bore and forming a projection;

a mold head received in the second central bore of the rotation head and attached to the shaft of the linear motion mechanism, the mold head having a cylindrical outer end comprising a plurality of sector-shaped chunk blocks defining at least one diametrically extending channel adapted to accommodate a length of a spring wire that makes a spring therein, each chunk block having circumferential corners that are made rounded and having different radii of curvature, and each of the chunk blocks extending radially outward to an inner face of the second central bore of the rotation head.

2. The mold head device of claim 1, wherein the linear motion driving device comprises a pneumatic cylinder having a rod connected to the shaft of the linear motion mechanism.

3. The mold head device of claim 1, wherein two of the chunk blocks are disposed on each side of the channel.

4. The mold head device of claim 1, wherein the channel has a width substantially equal to a width of the wire.

5. A mold head device of spring forming machine comprising:

a rotation mechanism having a cylindrical body defining a first central bore, the cylindrical body being drivingly coupled to a torque/rotation source;

a linear motion mechanism having a shaft axially and movably received in the first central bore of the cylindrical body, the shaft being drivingly coupled to a linear motion driving device;

a rotation head fixed to the cylindrical body, the rotation head defining a second central bore and forming a projection;

a mold head received in the second central bore of the rotation head and attached to the shaft of the linear motion mechanism, the mold head having a cylindrical outer end comprising a plurality of sector-shaped chunk blocks defining at least one diametrically extending channel adapted to accommodate a length of a spring wire that makes a spring therein, each chunk block having circumferential corners that are made rounded and having different radii of curvature, and each of the chunk blocks having concave inner faces.

6. The mold head device of claim 5, wherein the linear motion driving device comprises a pneumatic cylinder having a rod connected to the shaft of the linear motion mechanism.

7. The mold head device of claim 5, wherein the mold head has a third central bore, the radius of curvature of the third central bore and the concave inner faces of the chunk blocks being substantially equal.

* * * * *